US005121544A

United States Patent [19]

Gilbert

[11] Patent Number: 5,121,544

[45] Date of Patent: Jun. 16, 1992

[54] REPLACEABLE BLADE KNIFE

[75] Inventor: Richard Gilbert, Dronfield, Great Britain

[73] Assignee: The Stanley Works Limited

[21] Appl. No.: 715,435

[22] Filed: Jun. 14, 1991

[30] Foreign Application Priority Data

Jun. 18, 1990 [EP] European Pat. Off. ..... 90306618.1

[51] Int. Cl.[5] ..... B26B 1/00

[52] U.S. Cl. ..... 30/162; 30/335; 30/336

[58] Field of Search ..... 30/162, 156, 349, 335, 30/336, 337, 338, 340, 125

[56] References Cited

U.S. PATENT DOCUMENTS

| | | | |
|---|---|---|---|
| 3,593,417 | 7/1971 | West et al. | 30/125 |
| 3,660,895 | 5/1972 | West | 30/162 |
| 3,857,176 | 12/1974 | Quenot | 30/335 |
| 3,863,339 | 2/1975 | Reaney et al. | 30/162 |
| 3,872,591 | 3/1975 | Quenot | 30/162 |
| 4,209,900 | 7/1980 | Gilbert | 30/162 |
| 4,240,202 | 12/1980 | Gilbert | 30/162 |
| 4,292,738 | 10/1981 | Osada | 30/162 |
| 4,524,518 | 6/1985 | West | 30/330 |
| 4,884,307 | 12/1989 | Flood | 30/162 |
| 4,884,342 | 12/1989 | McNamara et al. | 30/335 |
| 4,939,839 | 7/1990 | Gorst | 30/335 |
| 5,001,834 | 3/1991 | Collins | 30/162 |
| 5,014,429 | 5/1991 | McNamara | 30/162 |

*Primary Examiner*—Frank T. Yost
*Assistant Examiner*—Hwei-Siu Payer
*Attorney, Agent, or Firm*—Chilton, Alix & Van Kirk

[57] ABSTRACT

A replaceable blade knife comprises two elongate handle portions and a blade carrier assembled together; the blade protruding, or being arranged to protrude, from a front end of the handle, between respective front ends of the two handle portions. The upper handle portion has a thumb-nail-sized aperture through a rear end part thereof. When the knife is assembled, the two handle portions are slid relatively longitudinally of one another, the upper handle portion moving forwardly of the lower handle portion, until a latch part near the rear end of the lower handle portion clicks into latching engagement with the front edge of the aperture in the upper handle portion. The upper handle portion is formed near its front end with two downwardly projecting flank portions, each flank portion having an integral, forewardly projecting piece at the bottom of the flank portion. The front of the lower handle portion is formed with upwardly projecting flank portions, each flank portion having an integral, rearwardly projecting piece at the top of the flank portion, to overlie and hence interlock with a forwardly projecting piece at the bottom of the corresponding flank portion of the upper handle portion.

10 Claims, 3 Drawing Sheets

REPLACEABLE BLADE KNIFE

FIELD OF THE INVENTION

This invention relates to a replaceable blade knife comprising an elongate handle, formed by two elongate handle portions, and a blade carrier assembled together; the blade protruding, or being arranged to protrude, from a front end of the handle, between respective front ends of the two handle portions.

The blade may or may not be extendable and retractable and may or may not be a snap-off blade, adapted for used bits of the blade to be snapped-off and discarded from time to time.

SUMMARY OF THE INVENTION

The invention provides a replaceable blade knife comprising an elongate handle, formed by two elongate handle portions, and a blade carrier assembled together;

the blade protruding, or being arranged to protrude, from a front end of the handle, between respective front ends of the two handle portions;

the two handle portions interlocking together with each other at or near the front end of the handle to resist splaying apart thereof in the event of side loading of the blade;

a first one of said two handle portions having an aperture through a rear end part thereof; the second handle portion having a resiliently deflectable, integrally formed latch part which occupies said aperture when the two handle portions are assembled together;

said latch part being in the form of a cantilever extending generally forwardly and at an angle to the plane of the blade, to protrude into said aperture, from its attachment point to a main body part of said second handle portion;

a front end of said latch part latchingly engaging a front edge of said aperture and being biased longitudinally of the handle into said latching engagement due to longitudinal engagement of a resiliently flexible part of one handle portion with the other handle portion;

the two handle portions interlocking with each other also at or near the rear end of the handle, to prevent their being parted at the rear end of the handle; said latch part being resiliently deflectable out of said latching engagement by manual pressure applied through said aperture;

said two handle portions being thereupon longitudinally displaceable relative to one another, to disengage the interlocking together of the two handle portions and thereby allow separation of the two handle portions.

DETAILED DESCRIPTION OF PREFERRED EMBODIMENT

Figure 1:
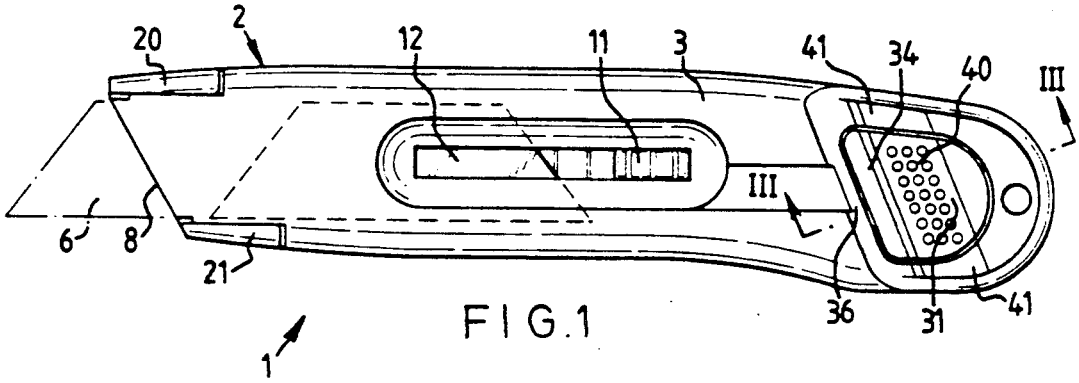
FIG. 1 is a front elevational view of a replaceable blade knife embodying the invention.
Figure 2:
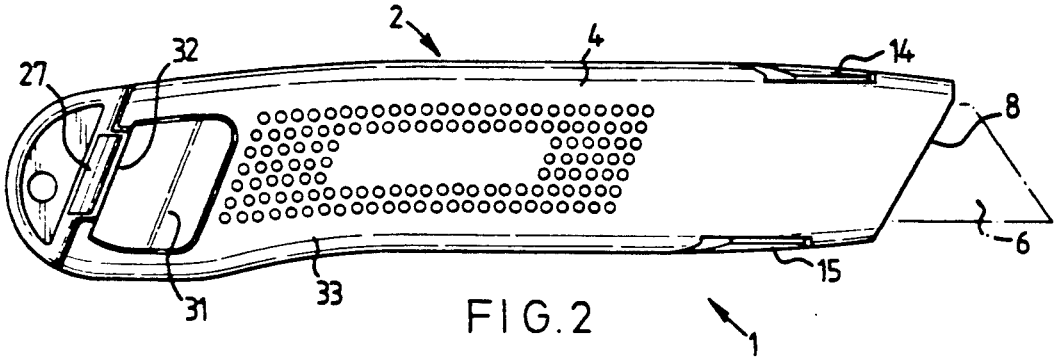
FIG. 2 is a rear elevational view of the replaceable blade knife embodying the invention of FIG. 1.
Figure 3:
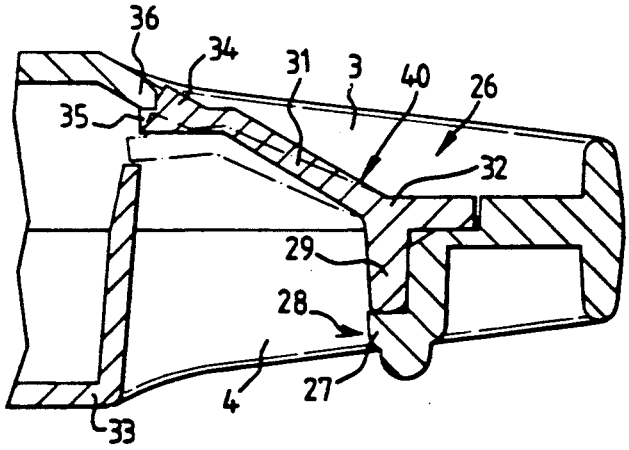
FIG. 3 is a section on III—III of FIGS. 1.
Figure 4:
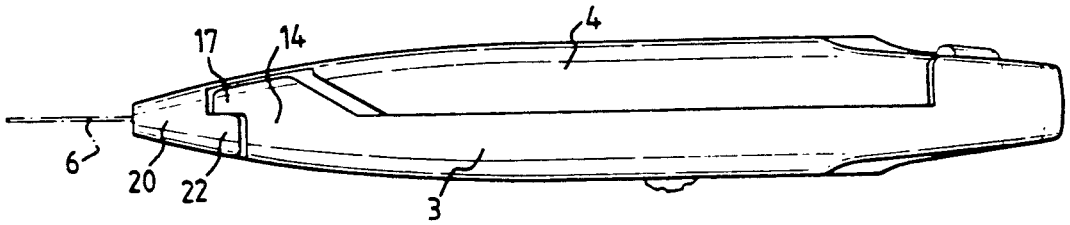
FIG. 4 is a top view of the knife of FIGS. 1 to 3.
Figure 5:
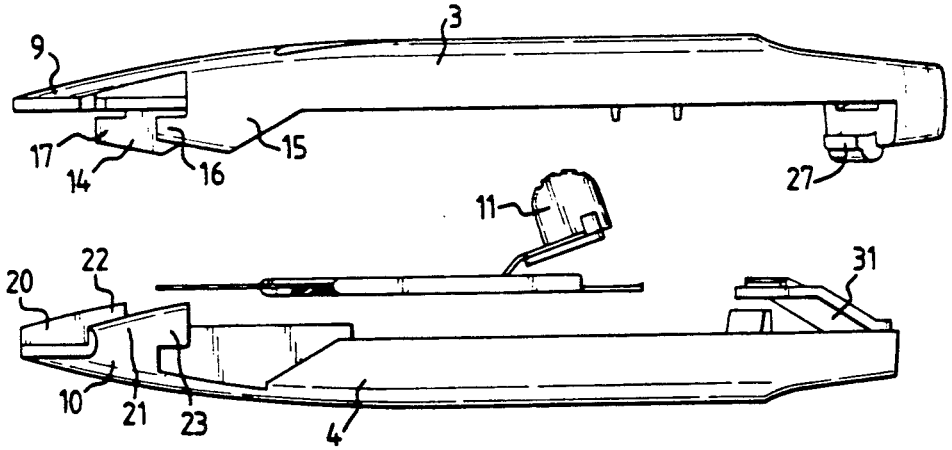
FIG. 5 is an exploded underneath view of the knife of FIGS. 1 to 4.

The invention will be described by way of example with reference to the drawings.

The illustrated replaceable blade knife 1 comprises an elongate handle 2 formed by two elongate handle portions 3, 4 of plastics material, namely, an upper handle portion 3 and a lower handle portion 4, and a blade carrier 5, assembled together. A blade 6 is mounted on the blade carrier 5, which is housed within the handle 2 and is adapted and arranged to slide along guides 7 within the handle 2 towards and away from the front end 8 of the handle 2, to extend and retract the blade 6. When extended, the blade 6 protrudes from the front end 8 of the handle 2 between respective front ends 9, 10 of the two handle portions 3, 4. The blade carrier 5 is provided with a resiliently biased button 11 which protrudes through an elongate slot 12 in the upper handle portion 3 for extending and retracting the blade 6, the button 11 being biased into releaseable engagement with internal detent formations 13 on the upper handle portion 3, at each side of the slot 12.

Figure 6:
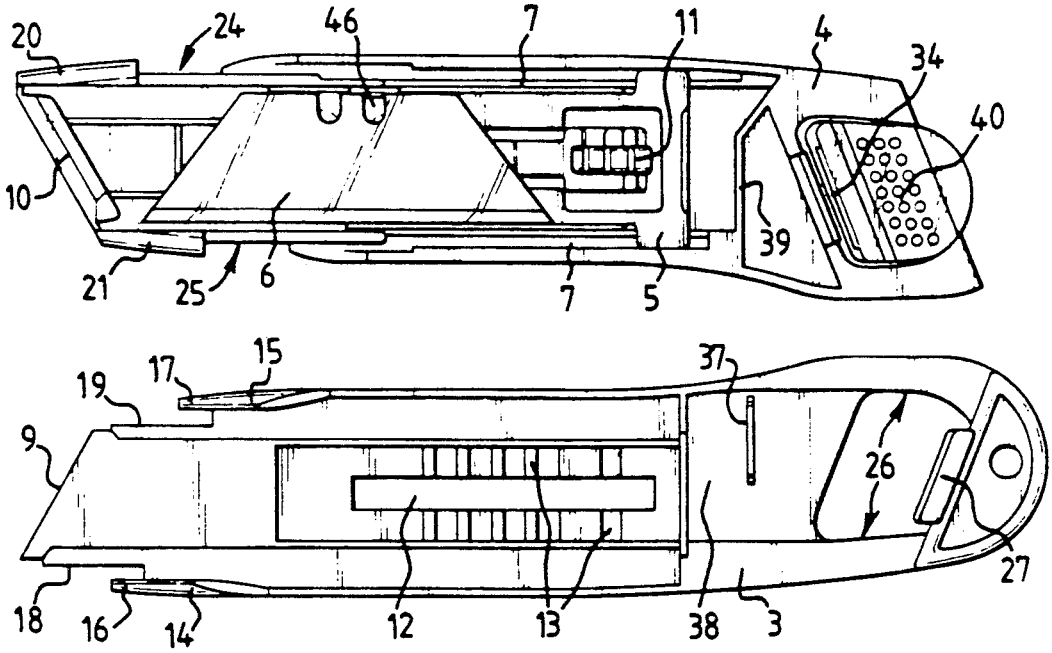
FIG. 6 is a view of the insides of the two handle portion and the blade carrier with blade of the knife of FIGS. 1 to 5.

The upper handle portion 3 is formed near its front end 9 with two downwardly projecting flank portions 14, 15 at the top and bottom sides of the upper handle portion 3 respectively, spaced rearwardly a little from the very front end 9 of the upper handle portion 3. Each said flank portion 14, 15 of the upper handle portion 3 has an integral, forwardly projecting piece 16, 17 at the bottom of the flank portion, to interlock with the lower handle portion 4 in a manner to be described. As shown in FIG. 6, the upper handle portion 3 is cut away at 18 and 19 to receive upwardly projecting flank portions 20, 21 of the lower handle portion 4, in a manner to be described.

The lower handle portion 4 is formed at the very front thereof with the above-mentioned upwardly projecting flank portions 20, 21. Each said flank portion 20, 21 of the lower handle portion 4 has an integral, rearwardly projecting piece 22, 23 at the top of the flank portion, to overlie and hence interlock with the forwardly projecting piece 16, 17 at the bottom of the corresponding flank portion 4, 5 of the upper handle portion 3. As shown in FIG. 6, the lower handle portion 4 is formed with two recesses 24, 25 behind its two flank portions 20, 21, to receive the two flank portions 4, 5 of the upper handle portion 3, for interlocking the two handle portions 3, 4 together at the front end 8 of the handle 2.

The upper handle portion 3 has a thumb-nail-sized aperture 26 through a rear end part of the upper handle portion. At the rear edge of the aperture 26, the upper handle portion 3 is formed, at the bottom thereof, with a forwardly directed projection 27 which engages in a recess 28 at a rear wall 29 of the lower handle 4 portion to interlock the two handle portions 3, 4 together at the rear end of the handle 2, to prevent the two handle portions 3, 4 being parted at the rear end of the handle 2.

The lower handle portion 4 has a resiliently deflectable, integrally formed latch part 31 which occupies the aperture 26 when the two handle portions 3, 4 are assembled together. The latch part 31 is in the form of a cantilever extending generally forwardly and at an angle to the plane of the blade 6, to protrude into the aperture 26, from its attachment point at 32 to the rear end of a main body part 33 of the lower handle portion 4. A front end 34 of the latch part 31 is of stepped formation, to provide a narrow, forwardly projecting, ledge 35. This front end 34 of the latch part 31 latchingly engages a front edge 36 of the aperture 26 when the two handle portions 3, 4 are assembled together. The front edge 36 of the aperture 26 in the upper handle portion 3 presses down upon the ledge 35 of the latch part 31, giving the latch part 31 a slight resilient deflection to maintain latching engagement.

An internal, integral, resiliently flexible spring leaf 37 of the upper handle portion 3 projects downwardly from a top wall 38 of the upper handle portion, and longitudinally engages the rear of an internal rib 39 of the lower handle portion 4, so as to tend to push the lower handle portion 4 forwardly of the upper handle portion 3 and thereby bias the front end 34 of the latch part 31 longitudinally of the handle 2 into its latching engagement with the front edge 36 of the aperture 26.

When the two handle portions 3, 4 are assembled together, the flank portions 14, 15 at the front end of the upper handle portion fit generally behind the flank portions 20, 21 at the front end of the lower handle portion 4, interlocked by the lower handle portion flank portion pieces 22, 23 overlying the upper handle portion flank portion pieces 16, 17 as described above. The external or upper surface 40 of the latch part 31 follows the contour of the external or upper surface 41 of the upper handle portion 3 around the edge of the aperture 26, sloping relative to the plane of the blade 6. The latch part 31 is resiliently deflectable out of the latching engagement with the front edge 36 of the aperture 26 by a manual pressure applied to the upper surface 40 of the latch part 31 within the aperture 26. The disengagement of latch part 31 necessitates—due to the angle of the latch part 31 to the plane of the blade 6—a very slight rearward movement of the lower handle portion 4 against the resilient bias of the spring leaf 37 of the upper handle portion 3. The two handle portions 3, 4 are thereupon longitudinally displaceable in the opposite direction relative to one another, the upper handle portion 3 moving rearwardly of the lower handle portion 4, to disengage the interlocking both at the front end and at the rear end of the handle 2 and thereby allow separation of the two handle portions 3, 4, for replacing the blade 6.

When the knife 1 is reassembled, the two handle portions 3, 4 are slid relatively longitudinally of one another, the upper handle portion 3 moving forwardly of the lower handle portion 4, until the latch part 31 clicks into latching engagement with the front edge 36 of the aperture 26 in the upper handle portion 3.

Figure 7:
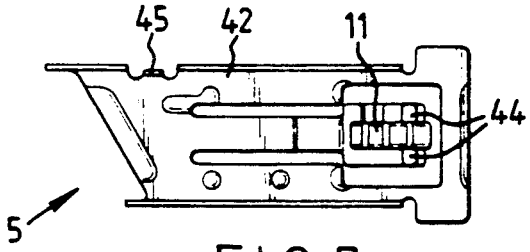
FIGS. 7, 8 and 9 are respectively a front view, a side view and an end view of the blade carrier of the knife of FIGS. 1 to 6.
Figure 8:
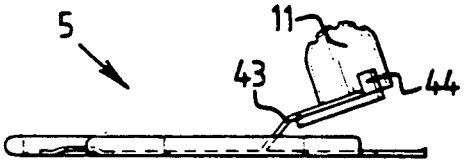
Figure 9:
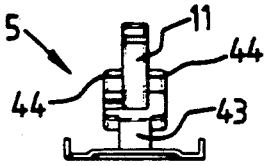

As shown in FIGS. 7 to 9, the blade carrier 5 is of conventional construction, comprising a pressed metal piece 42 and the above-mentioned button 11, which is a plastic button which is assembled onto an upwardly bent cantilever spring portion 43 of the metal piece 42. The plastic button 11 has side projections 44 to engage the detents 13 of the upper handle portion 3. The metal piece 42 is formed with the usual projection 45 to engage in a recess 46 in the non-cutting edge of the blade 6, to interlock the blade 6 with the blade carrier 5 in the usual way.

I claim:

1. A replaceable blade knife comprising an elongate handle, formed by two elongate handle portions, and a blade carrier assembled together; said handle being adapted to carry a blade protruding, or being arranged to protrude, from a front end of the handle, between respective front ends of the two handle portions;

front end interlocking means for interlocking the portions together with each other at or near the front end of the handle to resist splaying apart thereof in the event of side loading of the blade;

a first one of said two handle portions having an aperture through a rear end part thereof; the second handle portion having a resiliently deflectable, integrally formed latch part which occupies said aperture when the two handle portions are assembled together;

said latch being in the form of a cantilever extending generally forwardly to protrude into said aperture;

a front end of said latch part latchingly engaging a front edge of said aperture and being biased longitudinally of the handle into said latching engagement to prevent the two handle portions from being parted at the rear end of the handle;

said latch part being resiliently deflectable out of said latching engagement by manual pressure applied through said aperture;

said two handle portions being longitudinally displaceable relative to one anther when said latch part is out of said latching engagement, to disengage the two handle portions and thereby allow separation of the two handle portions.

2. A knife as claimed in claim 1, wherein the latch part and the front edge of the aperture have a stepped formation on at least one thereof, where they interengage, to maintain the latching engagement thereof.

3. A knife as claimed in claim 2, wherein the stepped formation is on the latch part.

4. A knife as claimed in claim 1 wherein said two handle portions carry said blade within a longitudinally extending plane and said latch part extends from said second handle portion at an angle to said plane.

5. A knife as claimed in claim 1 wherein said front end interlocking means is integral with said handle portions.

6. A knife as claimed in claim 1 wherein one of said handle portions includes a resiliently flexible spring member engagable with the other handle portion when the two handle portions are assembled to longitudinally bias said latch part into latchable engagement with said front edge of said aperture.

7. A knife as claimed in claim 6, wherein one of said handle portions includes a wall and said resiliently flexible spring member is an internal downwardly extending projection from said wall.

8. A knife as claimed in claim 7 wherein the latch part includes a stepped formation.

9. A knife as claimed in claim 1 wherein said front end interlocking means includes an opposed longitudinally projecting member and complementary recess on opposite handle portions that cooperate upon relative longitudinal movement of said handle portions to retain and release the locking engagement between said portions.

10. A knife as claimed in claim 9 wherein said projecting member and recess are maintained in cooperative interlocking engagement when said latch part is latching by engaging said front edge of said aperture.

* * * * *